US006289542B1

(12) United States Patent
Dignam

(10) Patent No.: US 6,289,542 B1
(45) Date of Patent: Sep. 18, 2001

(54) COMBINED REMOTE CONTROLLER AND BOTTLE OPENING DEVICE

(76) Inventor: David Dignam, 157 Suffolk St., New York, NY (US) 10002

( * ) Notice: Subject to any disclaimer, the term of this patent is extended or adjusted under 35 U.S.C. 154(b) by 0 days.

(21) Appl. No.: 09/479,372

(22) Filed: Jan. 5, 2000

(51) Int. Cl.[7] ..... B25F 1/00; B67B 7/16

(52) U.S. Cl. ..... 7/151; 7/170

(58) Field of Search ..... 7/151, 170; D8/33, D8/34; 348/734

*Primary Examiner*—D. S. Meislin
(74) *Attorney, Agent, or Firm*—Mitchell A. Stein; Stein & Associates, P.C.

(57) ABSTRACT

An electronic device controlling and bottle opening device, having a handle portion for grasping; a top portion of the handle portion having a keypad; a rear portion behind the top portion and having an aperture; and a bottle opening device fixedly displaced within the aperture. The bottle opening device has a bottle opening top portion for engagement with the rear portion of the device; an optional substantially centrally defined dimpled extension; and a pair of downwardly displaced extension portions depending from the top portion for engagement of the edge of a bottle cap for opening, and for leveraging the bottle cap by grasping the handle portion. The device can be used by leveraging by upward pulling against the bottle cap or by downward pushing against the bottle cap. The downwardly displaced extension portions are preferably substantially curvilinear or linear. In particular dimension, an internal bottle-cap-interfacing longitudinal dimension of a distance "$d_1$" is defined as the distance between the interior surface of one of the extension portions and the center between the two extension portions, and the cap of the bottle has a radius of "$d_2$," wherein $d_1>d_2$.

7 Claims, 6 Drawing Sheets

LOCK-IN CLIP

BOTTLE OPENER

COMBINED REMOTE CONTROLLER AND BOTTLE OPENING DEVICE

FIELD OF THE INVENTION

The present invention relates to the field of personal accessories and more particularly to a combined television, stereo or other electronic device controller having a bottle opener fixedly engaged therein for convenience of opening beverages with twist or capped tops without the need to leave the comfort of a sofa or couch and without the need to search for both devices.

BACKGROUND OF THE INVENTION

With frequency, the male members of the public traditionally are engaged in watching televised sports events while simultaneously imbibing beverages from containers having caps. The television or stereo remote controller has probably become the most widely used device in the household. Likewise, second on the list of widely used devices (for those who enjoy sports events with a good bottle of beer in the company of other enthusiasts) is the bottle opener.

Unfortunately, these two devices have heretofore not shared the same physical space. In fact, each has taken its turn at "disappearing" just when it is required. Additionally, in the heat of the moment of intense sports activities on the television set, no one desires to search out either the controller or the bottle opener. All, however, need access to both.

In order to satisfy this ever present demand for access to these two tools of universally recognized significance, the sports enthusiast may resort to the use of a key or other device rather than break from the sports event to search for the bottle opener.

With these ends in mind, it is an object of the present invention to satisfy the necessity of easy access to an electronic controller (for use in, e.g., stereo, television, cable, DVD, etc.) and a bottle opener.

Bottle opener designs of a plethora of variations are intrinsically associated with other devices (except a remote, electronic controller) are known in the art. See, e.g., U.S. Pat. Nos. 5,893,301; 5,829,965; 4,607,543; D415,398; D404,268; D395,384.

Accordingly, it is an object of the present invention to incorporate a bottle opener in a remote electronic controller, in the manner indicated hereinafter.

SUMMARY OF THE INVENTION

The foregoing and other objects are achieved by the instant invention which comprises an electronic device controlling and bottle opening device, having a handle portion for grasping; a top portion of the handle portion having a keypad; a rear portion behind the top portion and having an aperture; and a bottle opening device fixedly displaced within the aperture. The bottle opening device has a bottle opening top portion for engagement with the rear portion of the device; an optional substantially centrally defined dimpled extension; and a pair of downwardly displaced extension portions depending from the top portion for engagement of the edge of a bottle cap for opening, and for leveraging the bottle cap by grasping the handle portion. The device can be used by leveraging by upward pulling against the bottle cap or by downward pushing against the bottle cap. The downwardly displaced extension portions are preferably substantially curvilinear or linear. In particular dimension, an internal bottle-cap-interfacing longitudinal dimension of a distance "$d_1$" is defined as the distance between the interior surface of one of the extension portions and the center between the two extension portions, and the cap of the bottle has a radius of "$d_2$," wherein $d_1>d_2$. Where the dimpled extension is included, that extension is generally displaced in the center between the two extension portions, and hence "$d_1$" is the distance from one of the extension portions interior surface to the center of the dimpled extension.

It should be appreciated that the foregoing summary of the design of the instant invention achieves the objects of providing reliable bottle opening and remote controlling simultaneously, while allowing a retro fit of pre-existing controllers with a single metal insertable bottle opening device, as further described below. It should be appreciated that where metal is indicated as a material of choice, a durable plastic material that exhibits the necessary properties can be substituted without deviation from the spirit or intent of the invention.

Other features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

BRIEF DESCRIPTION OF THE DRAWINGS

In the drawings, wherein similar reference characters denote similar elements through the several views.

DETAILED DESCRIPTION OF THE PREFERRED EMBODIMENTS

Figure 1:
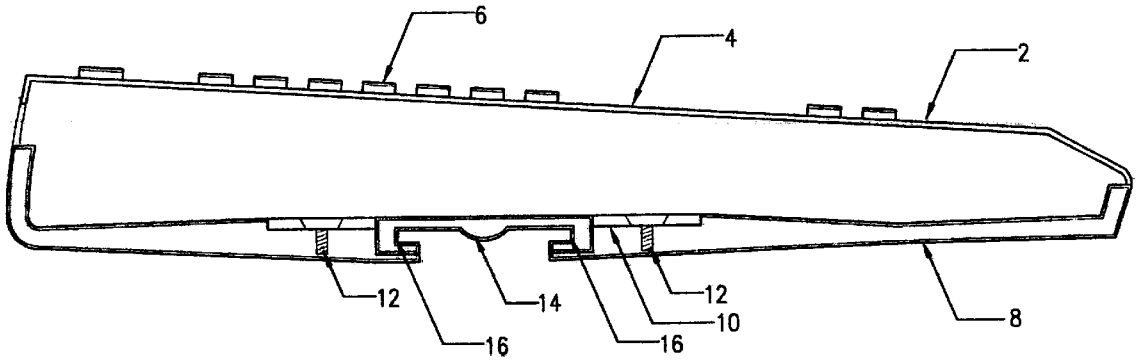
FIG. 1 is a cross-sectional view of a preferred embodiment of the subject invention.

As shown in FIG. 1, the present invention is directed to a combination of a bottle opener rigidly attached to a remote electronic controller in a manner that provides sufficient lever arm action without deformation or cracking of the plastic controller housing. It should be recognized that the mere addition of a bottle opener to the plastic housing would fail to work effectively, because the plastic would crack when the opener is used, or the opener would be extracted from the housing upon such use.

In order to accommodate a solution to the design requirements of merging these two heretofore independent mechanical and electronic items, it is herein shown that the bottom surface 8 of the plastic housing of the combined device 2 has a recess in which the bottle opening device is placed. The top surface 4 also has key pad 6 for typical use in remote controlling television sets, DVD systems, cable boxes, stereo systems, and the like. The bottle opening device comprises a top portion 10, having screws 12 which retain the assembly against the plastic housing. The top portion 10 possesses a central dimple 14 and curvilinear dependencies 16. Together the top portion 10, central dimple 14 and curvilinear dependencies 16 are together one piece of metal, in this embodiment, positioned to prevent torquing action when in the bottle engaged mode.

It should be appreciated that the location of the bottle opening device in the electronic controller is such that the printed circuit board, inside the device, as well as the battery compartment, typically at the back end of the device, are not interfered with when the bottle opening device is both inserted in the controller, and during operation of the combined device.

Figure 2A:
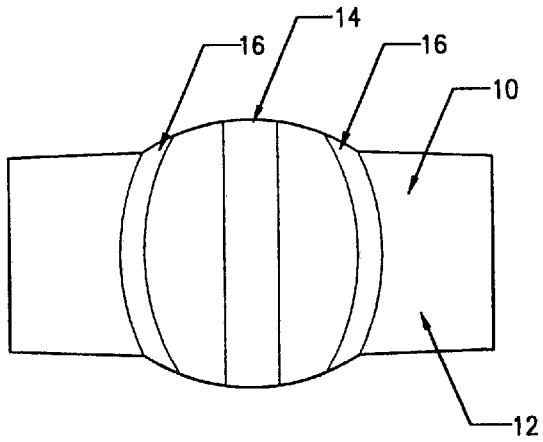
FIGS. 2A, 2B and 2C are, respectively, upward, downward and cross-sectional views of the bottle opening insert in accordance with a preferred embodiment of the subject invention.
Figure 2B:
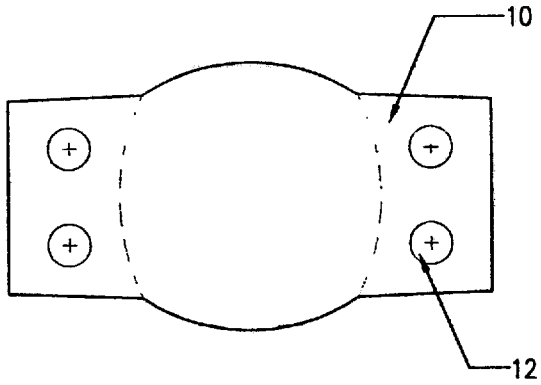
Figure 2C:
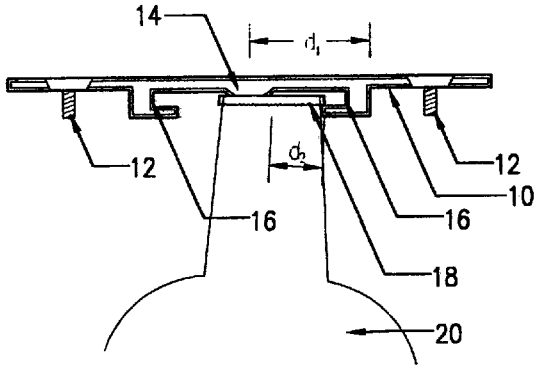

As shown in FIG. 2, the single, metal bottle opening device is shown looking upwardly (FIG. 2A), downwardly (FIG. 2B) and in cross-section in operation (FIG. 2C). It should be recognized that the dimple portion 14 is essentially straight, while the curvilinear dependencies 16 are in a curved path to provide for engagement of the curved bottle cap. As shown in FIG. 2C, the bottle cap 18 on bottle 20 is inserted into the device such that the lip of the cap engages between a curvilinear dependency 16 and the dimple 14 to provide a lever arm for bending the cap off of the bottle cap. It should also be appreciated that the cap may be removed, as shown, by pulling upwardly on the bottom of the bottle. If the bottle cap is inserted the opposingly directed dependency 16, the same lever arm action in the opposite direction, by pushing rather than pulling, will dislodge the cap. Thus, the cap may be removed in either of these two manners.

In order to provide a central channel between the two opposing, curvilinear dependencies 16 of sufficient size to accommodate the bottle cap pulling or pushing action referenced above, and as an important element of the specific design, the proper dimensions must be provided. In particular, if the distance between a dependency 16 and the center of the dimple 14 is defined as "$d_1$", and the radius of the bottle cap is defined as "$d_2$," then $d_1$ must always be greater than $d_2$ for the operation of the device to occur in conformity with the inventive concept stated herein.

Figure 3:
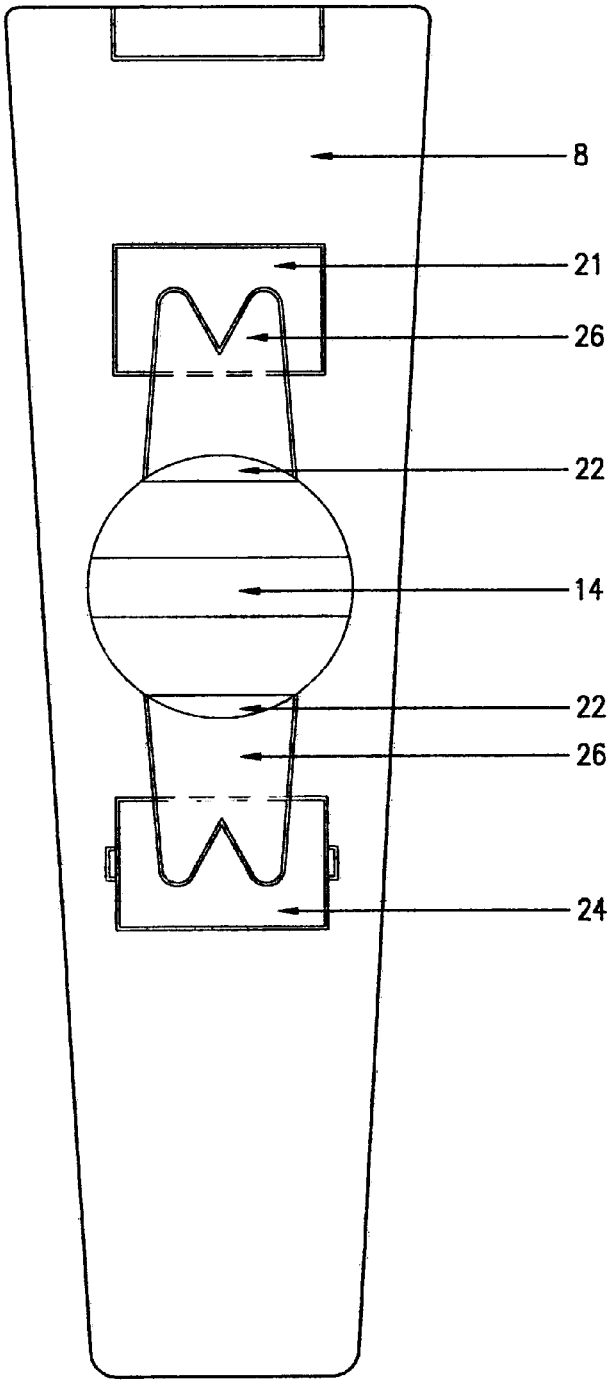
FIG. 3 is a upwardly directed, representative view of an alternative embodiment of the subject invention showing another bottle opening insert.

FIG. 3 shows an alternative, simplified embodiment, in which the insertable bottle opening device has a pair of winged flats 26. In this embodiment the entire opening device is still fabricated out of a single piece of metal. One of these winged flats 26 is inserted into a cutout 21 in the plastic of the bottom surface 8. The other winged flat 26 is maintained by way of a clip 24.

Figure 4A:
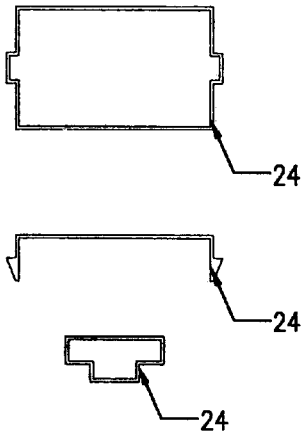
FIGS. 4A and 4B are, respectively, exploded views of the lock-in clip assembly and bottle opening insert of the alternative embodiment shown in FIG. 3.

The lock-in clip 24 is shown in three views in FIG. 4A, first downwardly, then cross-sectionally, then side plan view. This clip locks into the rear plastic surface 8 in order to retain the bottle opening device in the controller.

Figure 4B:
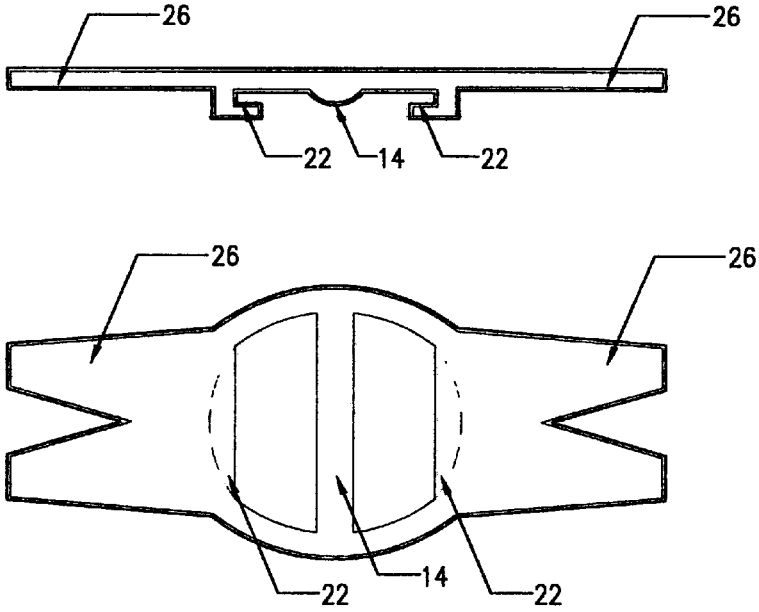

The bottle opening device shown in FIG. 3 is also shown, in plan view, outside of the controller, in FIG. 4B, in both cross-sectional view and downward view. In this manner, it should be appreciated that the extensions 22 for engaging the edge of the bottle cap are straight in this embodiment. The dimple 14 is also shown, but not required.

Figure 5:
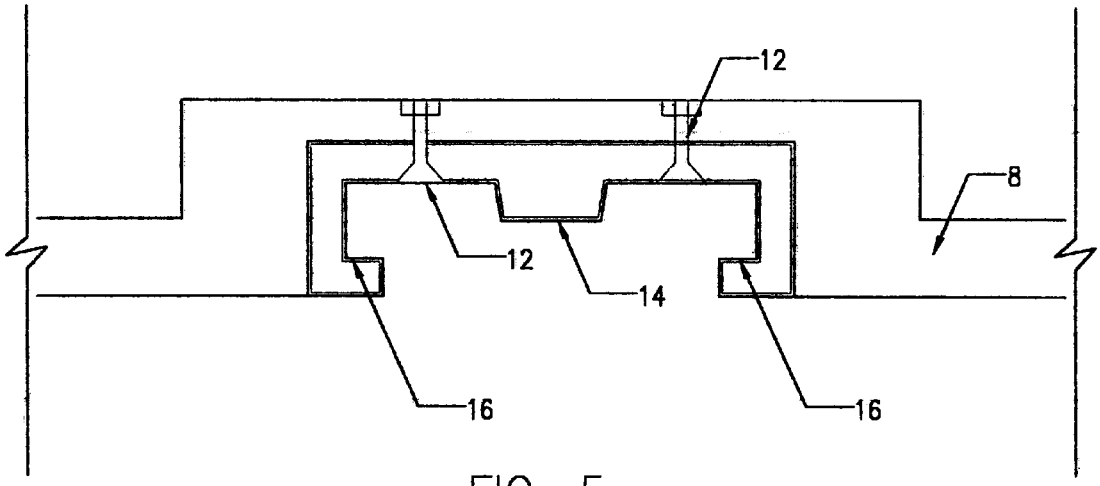
FIG. 5 is a cross-sectional representation of a still further embodiment of a bottle opening insert.

An alternative arrangement is shown in cross-section in FIG. 5, in which the single metal opener is much smaller in size, having the same general configuration, and retained against the plastic housing by way of screws 12 which are adjacent to the dimple 14.

Figure 6A:
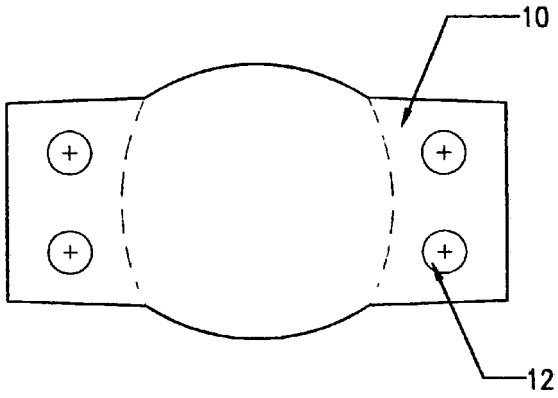
FIGS. 6A, 6B and 6C are, respectively, downward, cross-sectional and upward views of an additional bottle opening insert embodiment of the invention.
Figure 6B:
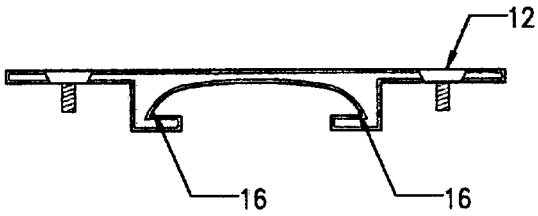
Figure 6C:
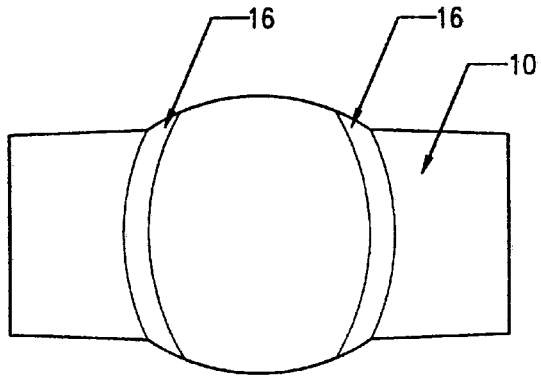

The currently most preferred embodiment for the opener portion is shown in FIGS. 6A, 6B and 6C which show the arrangement of the curvilinear dependencies 16 without the dimple 14. This simplified device demonstrates the greatest functionality and easiest in use.

While there have been shown, described and pointed out fundamental novel features of the invention as applied to preferred embodiments thereof, it will be understood that various omissions and substitutions and changes in the form and details of the device illustrated and in its operation may be made by those skilled in the art without departing from the spirit of the invention. It is the intention, therefore, to be limited only as indicated by the scope of the claims appended hereto.

I claim:

1. An electronic controlling device and bottle opening device, comprising:

(a) a handle portion for grasping;

(b) a top portion of said handle portion having a keypad;

(c) a rear portion behind said top portion and having an aperture; and (d) a bottle opening device fixedly displaced within said aperture and comprising:

(1) a bottle opening top portion for engagement with the rear portion of said device, and (2) a pair of downwardly displaced extension means depending from said top portion for engagement of the edge of a bottle cap for opening, and for leveraging the bottle cap against said extension means by grasping said handle portion.

2. The device of claim 1, wherein the bottle opening device further comprises a substantially centrally defined dimpled extension.

3. The device of claim 1, wherein said leveraging is created by upward pulling against the bottle cap.

4. The device of claim 1, wherein said leveraging is created by downward pushing against the bottle cap.

5. The device of claim 1, wherein said downwardly displaced extension means are substantially curvilinear.

6. The device of claim 1, wherein said downwardly displaced extension means are substantially linear.

7. The device of claim 2, wherein an internal bottle-cap-interfacing longitudinal dimension of a distance "$d_1$" is defined as the distance between the interior surface of one of said extension means, and the center of the dimpled extension, and $d_1$ is greater than the average radius of a bottle cap.

* * * * *